United States Patent [19]

Siler

[11] 4,190,974

[45] Mar. 4, 1980

[54] ARTISTS' CANVAS AND FRAME ASSEMBLY

[76] Inventor: Todd L. Siler, 43-49 10th St., Long Island City, N.Y. 11101

[21] Appl. No.: 917,565

[22] Filed: Jun. 21, 1978

[51] Int. Cl.[2] ..... D06C 3/08

[52] U.S. Cl. ..... 38/102.9; 160/377

[58] Field of Search ..... 38/102, 102.1, 102.2, 38/102.3, 102.4, 102.5, 102.9; 160/377, 378, 379, 380, 229 R, 374.1; 5/334 C

[56] References Cited

U.S. PATENT DOCUMENTS

| | | | |
|---|---|---|---|
| 581,897 | 5/1897 | White | 160/377 |
| 977,239 | 11/1910 | Toynbee | 160/377 |
| 1,325,961 | 12/1919 | Smith | 160/380 |
| 3,156,280 | 11/1964 | Affholter | 5/334 C |

*Primary Examiner*—Louis Rimrodt

*Attorney, Agent, or Firm*—Mawhinney, Mawhinney, & Connors

[57] ABSTRACT

An artists' canvas is preformed on its rear face with an integral perimetrical and an articulated frame is composed of sectionally hinged rigid pivotally interconnected bars and is disposed flat at the rear face and is movable from a collapsed pointed star shape into a rigid rectangular expanded condition wherein the hinged sections of each bar are in axial alignment and are held in such state by positive locking latches provided at each hinge point. In such expanded condition, the bars fit in the pocket and the expanded frame exerts a constant even stretching force in all directions on the canvas which is held in a taut condition, ready for artistic usage, and which can be removed undamaged from the frame.

10 Claims, 2 Drawing Figures

ARTISTS' CANVAS AND FRAME ASSEMBLY

BACKGROUND OF THE INVENTION

1. Field of the Invention

The present invention generally appertains to improvements in artists' painting technology and more particularly relates to a novel preformed canvas and to a novel canvas stretching assembly and to a new and novel articulated frame for stretching an artists' canvas and for use as a canvas supporting frame to provide a firm working surface for the artist.

2. Description of the Prior Art

In order that oil paintings can properly be done, it is first necessary to stretch the canvas on which the oil painting is to be made. Customarily, the canvas is cut, fitted and stretched across a rectangular wooden frame and tacked or stapled to the exterior edges of the frame. So that the canvas can be stretched under tension, the frame is usually expanded, primarily by structural means disposed at the corners of the frame.

Thus, in U.S. Pat. No. 55,579, the wooden strips of the frame are loosely connected at their corners by a tongue and groove arrangement and the frame is expanded by movement of the strips at the corners under the force of swivel buttons which bear against eccentric plates. The disadvantage of frames of this type lies in the fact that they are only slightly effective for a short period of time. The corners do not stay true in their relative movements and the mechanical forces tend to fail, thereby permitting the canvas to become slack.

Some attempts have been made to depart from movable corner constructions. Thus, in U.S. Pat. No. 2,760,299, inner and outer wooden frames are provided and the artists' water color paper, which could be a canvas, is stretched over the inner frame which is placed within the outer frame and mechanical forces in the form of bolt and nut assemblies are applied to move the inner frame toward the outer frame so as to exert a pull on the paper and stretch it.

Such an arrangement is unduly complicated and very time consuming and burdensome in use. In addition, this device, like the other devices, involves the use of a wooden frame which is not reliable for stretching purposes and which is not practically reusable. Also, such frame is heavy. The adjustable frame types, as disclosed in the foregoing patents, are cumbersome and structurally complicated.

Attempts have been made to provide stretching frames formed from metal. Thus, in U.S. Pat. No. 1,618,361, an expansible metal frame is disclosed. Such frame has upper and lower rigid rails connected by vertical stretching bars. The cloth is secured at its edges to the rails by a clamping means and the rails are spread apart to stretch the cloth by the spreading bars.

The main drawbacks with such a stretching frame are that the edges of the cloth are clamped by a complicated clamping arrangement to the bars and also by virtue of such clamping means care must be taken to ensure that the cloth edges do not tear under the strain of stretching. The cloth can only be stretched in two directions, namely, upwardly and downwardly. Additionally, the costs of the structure, especially the clamping arrangement, are prohibitive for artistic usage.

SUMMARY OF THE INVENTION

The foregoing brief review of the prior art, as it relates specifically to artistic paintings, reveals a lack of awareness of the problem of recycling as known today and an absence of any means to deal with such problem. In the modern space age, painters are still diligently tacking a canvas onto a wooden frame, painting on the canvas and then, if unsatisfied with the artistic endeavor, putting the work aside and taking a new wooden frame and cutting, shaping and tacking a new canvas on the new wooden frame.

The known frames offer no reusability, thereby denigrating recyclability. With known frames and canvases, a painter must spend mechanical time in cutting, shaping and affixing a canvas onto a frame. And then after eventual non-meaningful or non-significant artistic time, only discard the canvas and the frame and resort to further mechanical effort in preparing a new canvas and frame for further artistic endeavors.

Recognizing the economic, mechanic and time factors, it is a primary object of present invention to provide an artists' canvas stretching assembly which is simple, easy and foolproof to use, which is economical and reusable and which is reliable in use to exert an even and constant uniform tension on a canvas in all directions with any possibility of the canvas becoming slack being completely eliminated and with the canvas being held taut for artistic employment.

Another important object of the present invention is to provide an articulated stretching frame formed from rigid metal, aluminum or plastic and composed of pivotally interconnected bars with each bar having hinged sections so that the frame can be collapsed into a pointed star shape and expanded from such collapsed shape into a rigid shape, such as rectangular, wherein the sections of each bar are in axial alignment and are fixedly held in such alignment by positive latches located at the hinge points of the sections.

A further important object of the present invention is to provide a canvas having an integral pocket formed around its edges on its rear face and to provide a cooperative articulated frame of metal or plastic that is adapted to be disposed flat at the rear face and to be disposable in a collapsed state and expanded from such state into an open rigid frame fitted tightly in the pocket and locked by positive latch means in such expanded condition wherein it exerts an even and constant stretching action, with uniform tension, in all directions on the canvas.

A further important object of the subject invention is to provide a custom made canvas which does not have to be cut and shaped but which is formed ready for mounting on a stretching frame in a matter of seconds and which can be removed from such frame without being damaged.

It can be realized that the present invention relates to a ready made canvas and stretching and supporting frame whereby an artist can set up a canvas without time spent in mechanical fashion and whereby an artist can use fitted canvases and a single frame to his advantage in being able to devote his full time to artistic endeavor. In this regard, the reusability of the frame lends recyclability to the frame in favoring space and material conservation. The expansible frame of the present invention can be used to stretch and support any given number of canvases. It can be constantly reused as canvases are finished for storage or are to be discarded. However, at any point where the finished art is of a satisfactory nature the frame can be retained with the finished canvas for use as the final support for the canvas.

DESCRIPTION OF THE PREFERRED EMBODIMENT

Figure 1:
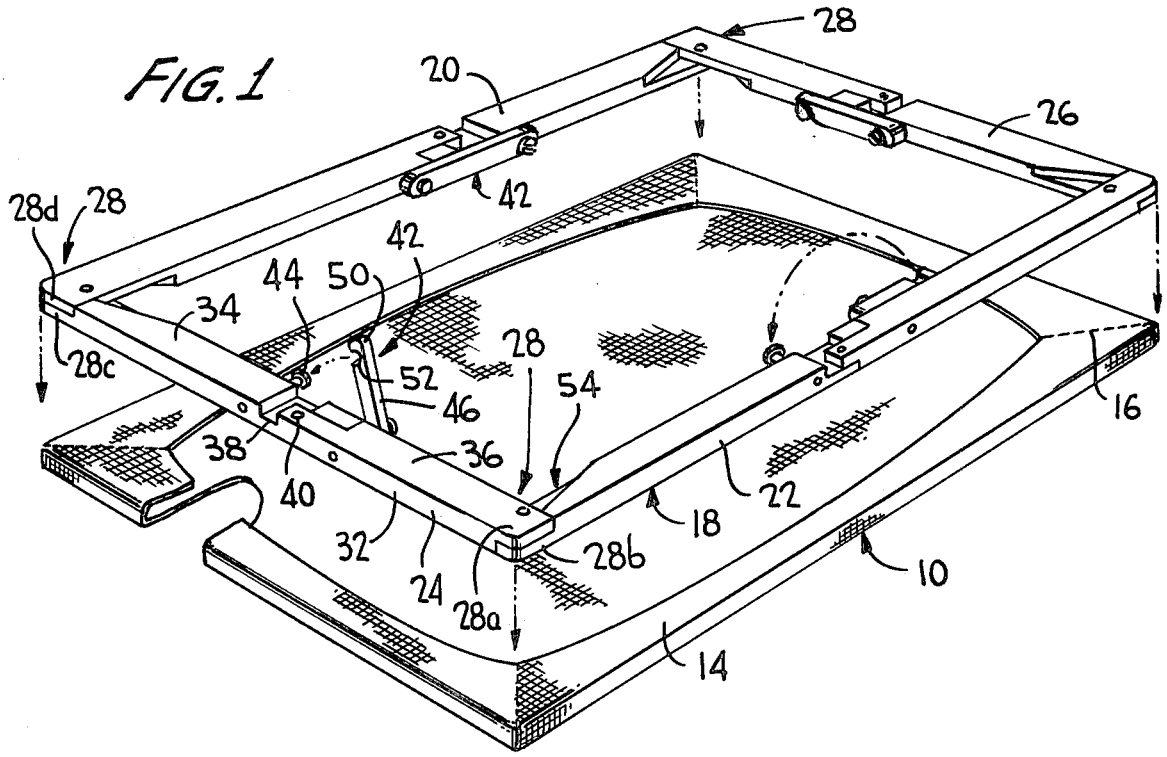
FIG. 1 is an exploded perspective view of the artists' canvas stretching assembly of the present invention with the canvas and the frame shown in a disassociated arrangement and with the frame shown in an expanded condition.

With more specific reference to the drawing, an artists' canvas 10 is shown. The canvas 10 is of rectangular shape for illustration purposes and has a rear face 12 and a front face (not shown) on which the oil or other artistic medium is placed. The side edges of the canvas are turned over and back onto the rear face of the canvas to form an integral perimetrical pocket 14 on the canvas back or rear face 12. The turned over edges and the rear face cooperate in defining the pocket 14. The turned over edges on the sides of the canvas are joined together by stitching 16 or other type of fastening devices, such as clip fasteners, to securely connect the edges and construct the pocket 14 which extends completely around the edges in an uninterrupted and continuous fashion at the rear face 12 of the canvas 10. The pocket 14 is of its greatest depth at the corners while the portions extending the length and width of the canvas are narrower but of substantially equal depth.

An articulated frame 18 is provided and is formed from a rigid and sturdy but lightweight material, such as, metal, aluminum or plastic. Rigidity and lightness are the desired attributes of the material. In the instance of the illustrated rectangular shaped canvas 12, the frame 18 is of an expanded rectangular shape. Thus, it is composed of longitudinal top and bottom bars 20 and 22, and vertical side bars 24 and 26 with the bars being pivotally interconnected.

In the latter respect, as can be understood from the drawing, the adjoining ends 28 of the bars are complementarily reduced in thickness so as to mate with each other in rotating overlapping fashion and are connected together by pivot pins 30. Preferably, as can be appreciated from considering the side bar 24 in FIG. 1, the opposite outer ends of each bar are of reduced thickness in an opposite manner. Thus, the reduced end **28*a* of the side bar 24 overlies the reduced end 28*b* of the longitudinal bar 22 while the reduced end 28*c* of the side bar 24 underlies the adjoining reduced end 28*d* of the longitudinal bar 20. In such fashion, the adjoining pivoted ends of the bars are of the same thickness as the body portions of the bars so that the entire frame 18 is of the same thickness throughout. And the thickness is such that the frame bars fit snugly in the pocket 14**.

Each of the bars is composed of at least two hinged sections. Thus, for example, the side bar 24 is made up of sections 32 and 34 having mating hingedly connected inner ends 36 and 38. The outer end of the bar section 34 is defined by the bar end **28*c* while the outer end of the bar section 32 is defined by the bar end 28*a***.

The inner end 36 of the bar section 32 is cut-away axially to produce an axial extension **36*a* with a cut-out 36*b* while the inner end 38 of the bar section 34 is similarly formed to have an axial extension 38*a* and a cut-out 38*b*. The extensions fit in the cut-outs when the bar sections 32 and 34** are in axial alignment in the fully expanded condition of the frame.

The outer end of the extension **36*a* overlies a reduced portion of the end 38 of the bar section 34 alongside the extension 38*a* and is hinged thereto by a pin 40 whereby the inner ends 36 and 38 of the bar sections 32 and 34 are hinged together for swinging movement about a pivot axis parallel to that of the outer ends about the pivot pins 30**.

The extensions **36*a* and 38*a* fit into the complemental cut-outs 36*b* and 38*b* in a way to stop the swinging movement of the inner ends and act as stops so as to locate the bar sections 32 and 34 in perfect axial alignment when the frame 18 is in its fully expanded state within the canvas pocket 14. A positive latch or locking means 42 is provided to securely hold such ends 36 and 38 in their abutting relation with the bar sections 32 and 34 in straight alignment. The latch means 42 includes a locking pin 44 fixed to and protruding inwardly from the inner side edge of the bar section 34 adjacent the inner end 38 and a catch 46 pivotally mounted at one end on a pin 48 fixed to and protruding inwardly from the inner side edge of the bar section 32 adjacent the inner end 36. The catch 46 has a free end 50 provided with a notch 52 to engage the pin 44**.

Figure 2:
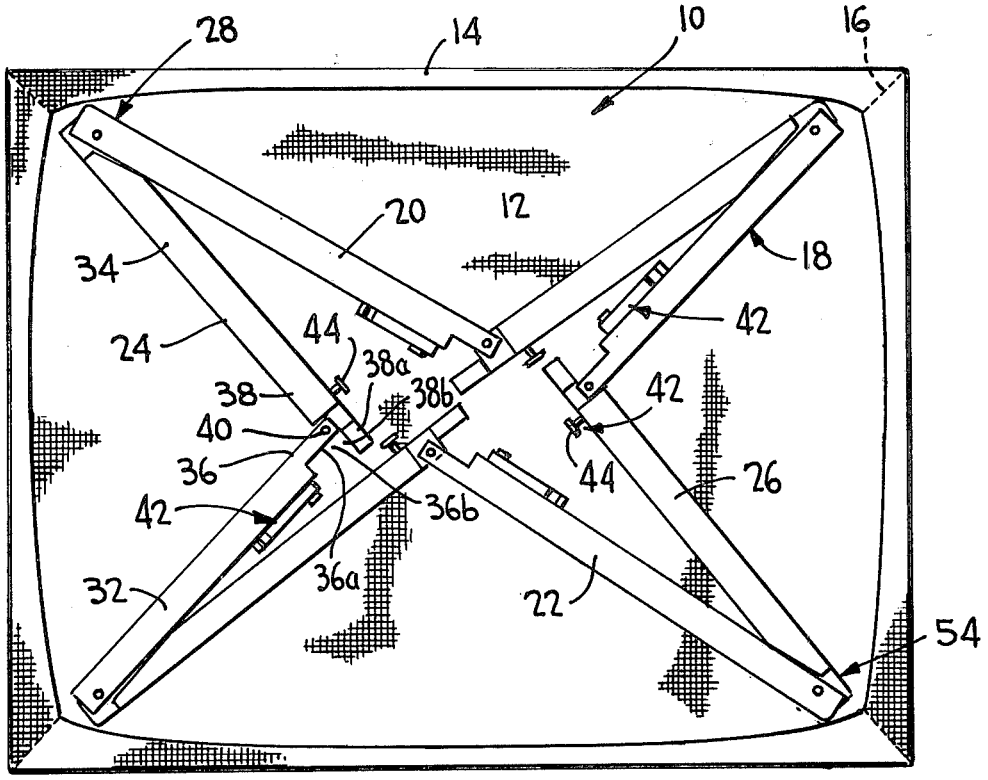
FIG. 2 is a plan view of the rear of the canvas with the frame shown in its collapsed state on the rear face of the canvas prior to its being expanded into the pocket on the edges of the rear face.

In use, as can be appreciated from a consideration of FIGS. 1 and 2, the canvas 10 is placed on a flat surface with its front face resting thereon and the articulated frame 18 is placed flat on the rear face 12 in a collapsed state as shown in FIG. 2. In such state the frame assumes a four pointed star shape. The frame is then moved into an expanded state by applying physical outward force on the bars 20, 22, 24 and 26 to move the frame bars into the pocket 14. The outward movement is arrested by the stops at the inner ends of the bar sections and by cooperating stops 54 on the adjoining outer ends of the bars.

When the hinged sections of each bar are in alignment, the inner ends are locked together by the latch means 42 whereby the frame is locked in its fully expanded condition within the pocket 16 wherein it exerts a stretching force on the canvas 10 in an even and constant manner and in every direction.

While the preferred embodiment of the present invention has been described herein and shown in the accompanying drawing, it is to be understood that such is merely exemplary in nature and that the invention is only to be construed and limited in accordance with the spirit and scope of the appended claims.

What is claimed is:

1. An artists' canvas stretching assembly comprising:

(a) a canvas having edges and a rear face and having a pocket formed at the edges and disposed on the rear face;

(b) an articulated frame composed of pivotally interconnected bars adapted to be disposed on the rear face and movable from a collapsed position into an expanded position wherein the bars are fitted into the pocket so as to apply a stretching force in all directions on the canvas;

(c) said bars having pivotally connected complemental outer ends, each bar being composed of at least two sections having outer ends constituting the outer ends of the bars and having inner complemental ends, means hingedly connecting the inner ends together for pivotal movement about an axis parallel to the axis of pivotal movement of the outer ends; and (d) latching means carried by the bars for locking the frame in a fully expanded state within the canvas pocket.

2. The invention of claim 1 wherein the pocket is continuous around the perimeter of the canvas and is formed integral with the edges so that the entire perimeter of the canvas is acted on by the frame.

3. The invention of claim 1 wherein the latching means is carried by the inner ends of the bar sections to lock the bar sections in axial alignment.

4. The invention of claim 3 wherein the latching means includes a pin carried by one inner end and a pivoted catch carried by the other inner end and having means to lockingly engage the pin.

5. The invention of claim 4 wherein the pin and catch are mounted on the inner sides of the bar sections.

6. The invention of claim 4 including stops for locating the bar sections and the bars in the fully expanded placement.

7. The invention of claim 1 wherein said frame in its fully expanded state is rectangular.

8. The invention of claim 1 wherein the pocket of the canvas is defined by the edges being turned over onto the rear face and joined thereto by stitching.

9. The invention of claim 1 wherein the pocket of the canvas is defined by the edges being turned over onto the rear face and joined thereto by staples.

10. For use in stretching an artists' canvas having pocket means provided on its edges at its rear face, a stretching unit comprising:

(a) an articulated open frame composed of pivotally interconnected bars, said bars having pivotally connected complemental outer ends, each bar being composed of at least two sections having outer ends constituting the outer ends of the bars and having inner complemental ends, means hingedly connecting the inner ends together for pivotal movement about an axis parallel to the axis of pivotal movement of the outer ends;

(b) said frame being movable from a collapsed state at the rear face of the canvas into a fully expanded condition with the bars fitted in the pocket; and, (c) locking means carried by the bars for securing the frame in such expanded condition.

* * * * *